US008699057B2

(12) United States Patent
Ohno

(10) Patent No.: US 8,699,057 B2
(45) Date of Patent: Apr. 15, 2014

(54) IMAGE FORMING APPARATUS, INFORMATION PROCESSING APPARATUS, INFORMATION PROCESSING SYSTEM, METHOD OF CONTROLLING IMAGE FORMING APPARATUS, METHOD OF CONTROLLING INFORMATION PROCESSING APPARATUS, AND STORAGE MEDIUM

(75) Inventor: Hajime Ohno, Fujisawa (JP)

(73) Assignee: Canon Kabushiki Kaisha (JP)

( * ) Notice: Subject to any disclaimer, the term of this patent is extended or adjusted under 35 U.S.C. 154(b) by 501 days.

(21) Appl. No.: 12/791,511

(22) Filed: Jun. 1, 2010

(65) Prior Publication Data

US 2010/0302588 A1 Dec. 2, 2010

(30) Foreign Application Priority Data

Jun. 1, 2009 (JP) ..... 2009-131932

(51) Int. Cl.
*G06F 3/12* (2006.01)
*G06F 15/00* (2006.01)
*G06K 1/00* (2006.01)

(52) U.S. Cl.
USPC ..... 358/1.15; 358/1.9; 358/1.2; 358/1.18; 358/1.1; 399/45; 399/69; 399/53; 399/341

(58) Field of Classification Search
None
See application file for complete search history.

(56) References Cited

U.S. PATENT DOCUMENTS 8,203,746 B2 * 6/2012 Shiozawa ..... 358/1.2
8,351,809 B2 * 1/2013 Takemura ..... 399/53
8,391,733 B2 * 3/2013 Shiozawa ..... 399/45
8,472,074 B2 * 6/2013 Yabe ..... 358/1.9
8,565,633 B2 * 10/2013 Sonohara et al. ..... 399/69
2005/0135851 A1 * 6/2005 Ng et al. ..... 399/341
2005/0169680 A1 * 8/2005 Ng et al. ..... 399/341
2007/0041051 A1 * 2/2007 Tanaka ..... 358/1.18
2007/0273917 A1 * 11/2007 Encrenaz et al. ..... 358/1.15
2008/0258454 A1 * 10/2008 Bhatt et al. ..... 283/67
2008/0285070 A1 * 11/2008 Takeuchi et al. ..... 358/1.15

(Continued)

FOREIGN PATENT DOCUMENTS

JP 2006-171306 A 6/2006
JP 2006-345049 A 12/2006

(Continued)

OTHER PUBLICATIONS

Extended European Search Report issued in corresponding European Patent Application No. 10164160.3 dated Sep. 14, 2010.

(Continued)

*Primary Examiner* — Satwant Singh
(74) *Attorney, Agent, or Firm* — Rossi, Kimms & McDowell LLP

(57) ABSTRACT

An arrangement which is capable of copying a clear toner image formed by a clear toner. In the image forming apparatus, a scanner section of an MFP reads an original. A CPU of the MFP determines whether or not position information indicative of a position where a clear-toner image formed by a clear toner is formed is contained in an image of the original read by the scanner section. When the CPU determines that the position information indicative of the position where the clear-toner image is formed is contained in the image of the original, the CPU forms the image of the original and the clear-toner image based on the position information.

13 Claims, 15 Drawing Sheets

(56) References Cited

U.S. PATENT DOCUMENTS

| | | | | |
|---|---|---|---|---|
| 2009/0086242 | A1* | 4/2009 | Kato | 358/1.13 |
| 2009/0169277 | A1 | 7/2009 | Fowlkes et al. | |
| 2009/0174908 | A1* | 7/2009 | Asai | 358/3.06 |
| 2009/0201560 | A1* | 8/2009 | Hashimoto | 358/474 |
| 2009/0225143 | A1* | 9/2009 | Fukui | 347/102 |
| 2009/0271697 | A1* | 10/2009 | Murrett | 715/234 |
| 2009/0279109 | A1* | 11/2009 | Shiozawa | 358/1.2 |
| 2009/0303504 | A1* | 12/2009 | Iinuma et al. | 358/1.9 |
| 2009/0316170 | A1* | 12/2009 | Tsujii | 358/1.9 |
| 2010/0104336 | A1* | 4/2010 | Christopher et al. | 399/341 |
| 2010/0195126 | A1* | 8/2010 | Shiozawa | 358/1.9 |
| 2010/0202811 | A1* | 8/2010 | Hryhorenko et al. | 399/341 |
| 2011/0038655 | A1* | 2/2011 | Ng et al. | 399/341 |
| 2011/0039202 | A1* | 2/2011 | Ng et al. | 430/124.1 |
| 2011/0222126 | A1* | 9/2011 | Asai et al. | 358/3.06 |

FOREIGN PATENT DOCUMENTS

| | | | |
|---|---|---|---|
| JP | 2007-011028 | A | 1/2007 |
| JP | 2007022003 | A | 2/2007 |
| JP | 2009-033437 | A | 2/2009 |

OTHER PUBLICATIONS

CN Office Action issued Apr. 20, 2012 for corresponding CN201010191940.5 (English translation provided).

KR Office Action issued Jul. 13, 2012 for corresponding KR 10-2010-0051604.

JP OA issued Jun. 4, 2013 for corres. JP 2009-131932.

* cited by examiner

| | | | |
|---|---|---|---|
| | HEADER SECTION | | 801 |
| | GRAPHIC SECTION | | 802 |
| | DATA CORRESPONDENCE DEFINITION SECTION | | 803 |
| 804 | OBJECT SECTION | IMAGE SECTION | 805 |
| | | CLEAR-TONER AREA SECTION | 806 |

| | | | | |
|---|---|---|---|---|
| 806 | CLEAR-TONER AREA SECTION | SHAPE | | RECTANGLE |
| | | POSITION | X | 80 |
| | | | Y | 60 |
| | | SIZE | X | 100 |
| | | | Y | 70 |
| | | INCLINATION | | 0 DEGREES |

| | | | |
|---|---|---|---|
| CLEAR-TONER AREA SECTION | SHAPE | | RECTANGLE |
| | POSITION | X | 80 |
| | | Y | 60 |
| | SIZE | X | 100 |
| | | Y | 70 |
| | INCLINATION | | 0 DEGREES |
| REFERENCE GRAPHIC SECTION | GRAPHIC ID | | 0x002F |

IMAGE FORMING APPARATUS, INFORMATION PROCESSING APPARATUS, INFORMATION PROCESSING SYSTEM, METHOD OF CONTROLLING IMAGE FORMING APPARATUS, METHOD OF CONTROLLING INFORMATION PROCESSING APPARATUS, AND STORAGE MEDIUM

BACKGROUND OF THE INVENTION

1. Field of the Invention

The present invention relates to an image forming apparatus, an information processing apparatus, an information processing system, a method of controlling the image forming apparatus, a method of controlling the information processing apparatus, and a storage medium.

2. Description of the Related Art

Image forming apparatuses having a copy function for printing image data of an original scanned by a scanner are known. Such image forming apparatuses produce an image of the original by projecting light onto the original and detecting light reflected from the original using sensors of a scanner section that read red (R), green (G), and blue (B) colors, respectively. The image is then printed to produce a copy of the image of the original.

An image forming apparatus that is capable of printing a transparent-toner (clear-toner) image on an image of an original is also known (see Japanese Patent Laid-Open Publication No. 2006-171306). The image forming apparatus is capable of glossing or protecting the image of the original (original image), by printing the original image and then superimposing the clear-toner image on the printed original image.

In the case of copying an image of an original including a portion printed with the clear toner, however, although portions of the image which are printed with toners other than the clear toner can be read by detecting the other portions using the sensors of the scanner section for reading the respective colors, the portion printed with the clear toner cannot be detected by the color read sensors since the clear toner is colorless, and hence the portion cannot be read. Accordingly, the user cannot get a copy product of the original on which the clear-toner image of the original is formed.

SUMMARY OF THE INVENTION

The present invention provides an arrangement which is capable of reading an original and thereby producing a copy product of the original on which a clear-toner image is formed.

In a first aspect of the present invention, there is provided an image forming apparatus comprising a reading unit configured to read an original, a determination unit configured to determine whether or not position information indicative of a position where a clear-toner image formed by a clear toner is contained in an image of the original read by the reading unit, and an image forming unit configured to form the image of the original and the clear-toner image based on the position information when the determination unit determines that the position information indicative of the position where the clear-toner image is formed is contained in the image of the original.

In a second aspect of the present invention, there is provided an information processing apparatus that transmits image data to an image forming apparatus, comprising a generation unit configured to generate position information indicative of a position where a clear-toner image formed by a clear toner is formed, and a transmission unit configured to transmit the position information to the image forming apparatus so as to cause the image forming apparatus to form the clear-toner image based on the position information generated by the generation unit.

In a third aspect of the present invention, there is provided a method of controlling an image forming apparatus equipped with a reading unit configured to read an original, comprising determining whether or not position information indicative of a position where a clear-toner image formed by a clear toner is formed is contained in an image of the original read by the reading unit, and forming the image of the original and the clear-toner image based on the position information when it is determined by the determining that the position information indicative of the position where the clear-toner image is formed is contained in the image of the original.

In a fourth aspect of the present invention, there is provided a method of controlling an information processing apparatus that transmits image data to an image forming apparatus, comprising generating position information indicative of a position where a clear-toner image formed by a clear toner is formed, and transmitting the position information to the image forming apparatus so as to cause the image forming apparatus to form the clear-toner image based on the position information generated by the generating.

In a fifth aspect of the present invention, there is provided a non-transitory computer-readable storage medium storing a program for causing a computer to execute a method of controlling an image forming apparatus equipped with a reading unit configured to read an original, wherein the method comprises determining whether or not position information indicative of a position where a clear-toner image formed by a clear toner is formed is contained in an image of the original read by the reading unit, and forming the image of the original and the clear-toner image based on the position information when it is determined by the determining that the position information indicative of the position where the clear-toner image is formed is contained in the image of the original.

In a sixth aspect of the present invention, there is provided a non-transitory computer-readable storage medium storing a program for causing a computer to execute a method of controlling an information processing apparatus that transmits image data to an image forming apparatus, wherein the method comprises generating position information indicative of a position where a clear-toner image formed by a clear toner is formed, and transmitting the position information to the image forming apparatus so as to cause the image forming apparatus to form the clear-toner image based on the position information generated by the generating.

In a seventh aspect of the present invention, there is provided an information processing system including an image forming apparatus, and an information processing apparatus that transmits image data to the image forming apparatus, the information processing apparatus comprising a generation unit configured to generate position information indicative of a position where a clear-toner image formed by a clear toner is formed, and a transmission unit configured to transmit the position information to the image forming apparatus, the image forming apparatus comprising a reception unit configured to receive the position information from the information processing apparatus, and an image forming unit configured to form, on a sheet, an image based on the position information received by the reception unit.

According to the present invention, it is possible to read an original and thereby produce a copy product of the original on which a clear-toner image is formed.

Further features of the present invention will become apparent from the following description of exemplary embodiments with reference to the attached drawings.

DETAILED DESCRIPTION OF THE EMBODIMENTS

The present invention will now be described in detail below with reference to the accompanying drawings showing embodiments thereof.

Figure 1:
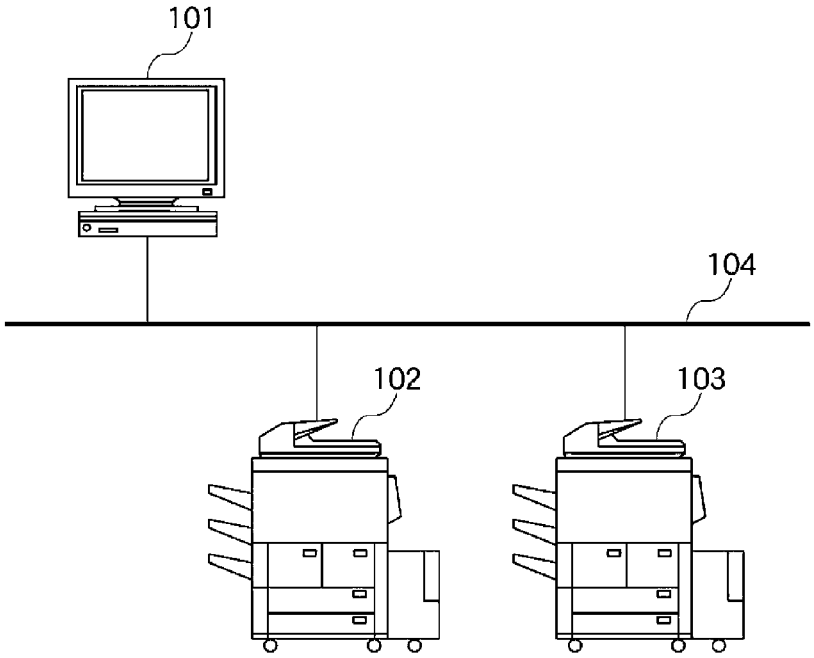
FIG. 1 is a schematic diagram of an image processing system according to a first embodiment of the present invention.

FIG. 1 is a schematic view of the configuration of an image processing system (image forming system) according to a first embodiment of the present invention.

As shown in FIG. 1, the image processing system of the present embodiment comprises a PC (Personal Computer) 101, an MFP (Multi-Function Printer) 102 and an MFP 103, which are interconnected by a network 104, such as a LAN, such that they are capable of communicating with each other.

The PC (information processing apparatus) 101 transmits image data generated by an image data-generating program to the MFP 102 or the MFP 103. Further, when transmitting the image data, the PC 101 is capable of accepting information on settings for printing the image data from a user via a printer driver, and transmitting the accepted information as a print job in association with the image data. Furthermore, the PC 101 is capable of generating image data to be printed using a clear toner (transparent toner) by the image data-generating program.

The MFP (image forming apparatus or image processing apparatus) 102 is a color multi-function printer equipped with a copy function, a facsimile function, a scanner function, a printing function, and so forth. The MFP 102 receives image data and a command from the PC 101, and performs image processing on the received image data according to the command. Furthermore, the MFP 102 reads an image of an original using a scanner section 304 (see FIG. 3), and prints the read image using a printer section 305.

Although in the present embodiment, the MFP 103 is a color multi-function printer having the same construction as that of the MFP 102, alternative constructions can be utilized. Further, each of the MFPs 102 and 103 may be replaced by an SFP (Single Function Printer) or a monochrome MFP. In the case of the monochrome MFP, it is assumed that printing can be performed not only with a black toner but also with a clear toner.

Next, an example of the hardware configuration of the PC 101 will be described with reference to FIG. 2.

Figure 2:
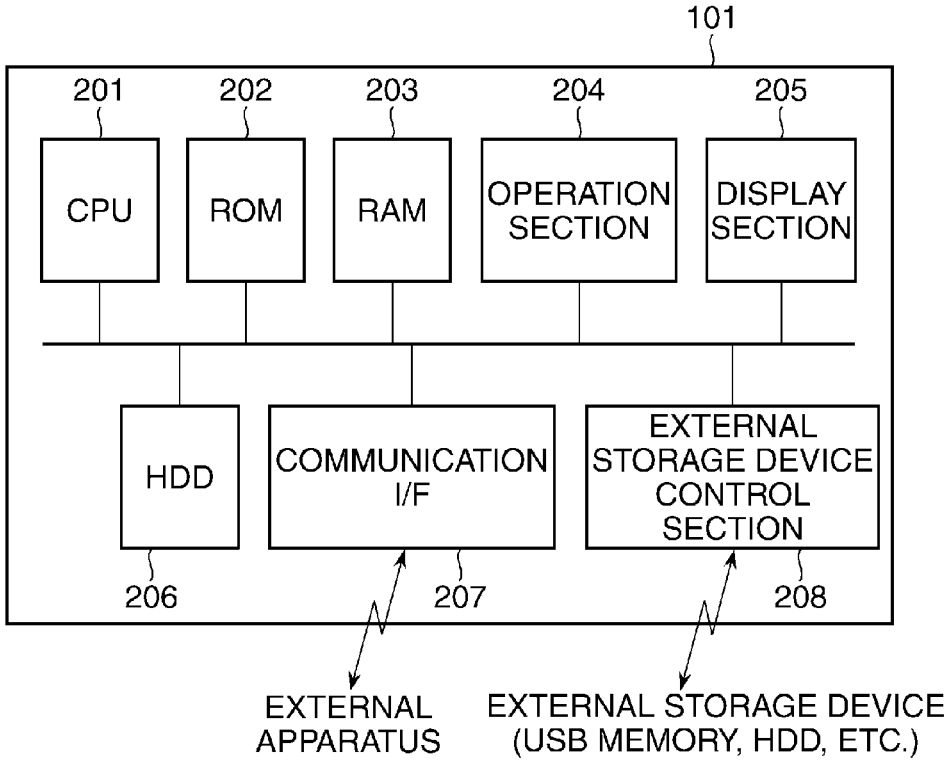
FIG. 2 is a schematic block diagram showing the hardware configuration of a PC (Personal Computer).

Referring to FIG. 2, a CPU 201 carries out various controls according to programs stored in a ROM 202. The ROM 202 stores not only the programs executed by the CPU 201 but also a boot program for starting the PC 101 and an OS (Operating System). When the CPU 201 executes the programs, a RAM 203 stores variables, data and the like, and is mainly used as a working memory for the CPU 201.

An operation section 204 comprises a keyboard and a mouse, neither of which is shown, and accepts operations and instructions from the user to the PC 101. A display section 205 includes a display and a VRAM (video RAM) which serves as a memory for display, neither of which is shown, and displays a screen on the display according to display data transferred from the CPU 201 to the VRAM. For example, the display section 205 displays on the display a software execution screen and a screen for use in giving an instruction to the MFP 102.

A HDD (Hard Disk Drive) 206 stores externally installed programs, and image data generated by programs. A communication interface 207 performs interface control for communication with an external apparatus (e.g. the MFP 102 or the MFP 103) connected to the PC 101 via the network 104. An external storage device control section 208 controls communication with an external storage device connected to the PC 101. Examples of the external storage device include a USB memory, an external HDD, and so forth.

Next, an example of the hardware configuration of the MFP 102 will be described with reference to FIG. 3.

Figure 3:
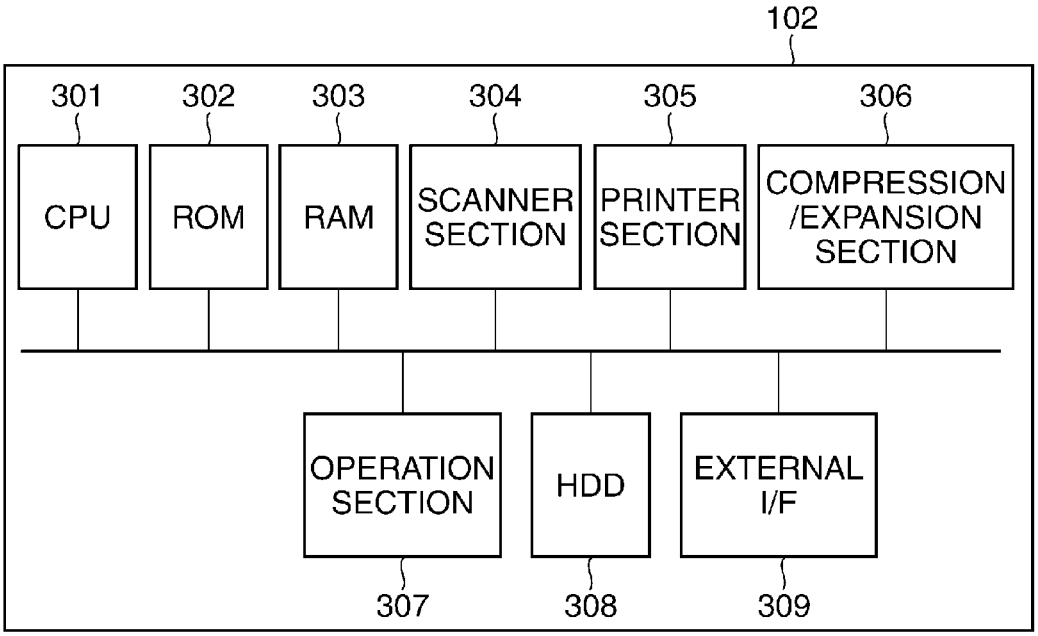
FIG. 3 is a schematic block diagram showing the hardware configuration of an MFP (Multi-Function Printer).

In FIG. 3, a CPU 301 carries out various controls according to programs stored in a ROM 302. The ROM 302 stores the programs executed by the CPU 301. When the CPU 301 executes a program, a RAM 303 stores variables, data and the like, and is mainly used as a working memory for the CPU 301.

The scanner section 304 scans an image of an original based on an instruction from the CPU 301, and converts the scanned image into image data. The printer section 305 prints out image data on sheets based on an instruction from the CPU 301. A compression/expansion section 306 compresses/expands image data.

An operation section 307 comprises a keyboard, a touch panel, an LCD (Liquid Crystal Display), and an LED (Light Emitting Diode), none of which are shown. The operation section 307 accepts various user operations performed e.g. for configuring print settings or instructing execution of a print job, and displays a printing status, a warning, or the like, for the user. A HDD 308 stores image data read by the scanner section 304 and image data received from the PC 101 via the network 104.

An external interface (I/F) 309 performs interface control for communication with an external apparatus (e.g. the PC 101 or the MFP 103) connected to the MFP 102 via the network 104. The MFP 103 has the same construction as that of the MFP 102, and hence description thereof is omitted.

Next, the mechanical construction of the hardware of the MFP 102 will be described with reference to FIG. 4.

Figure 4:
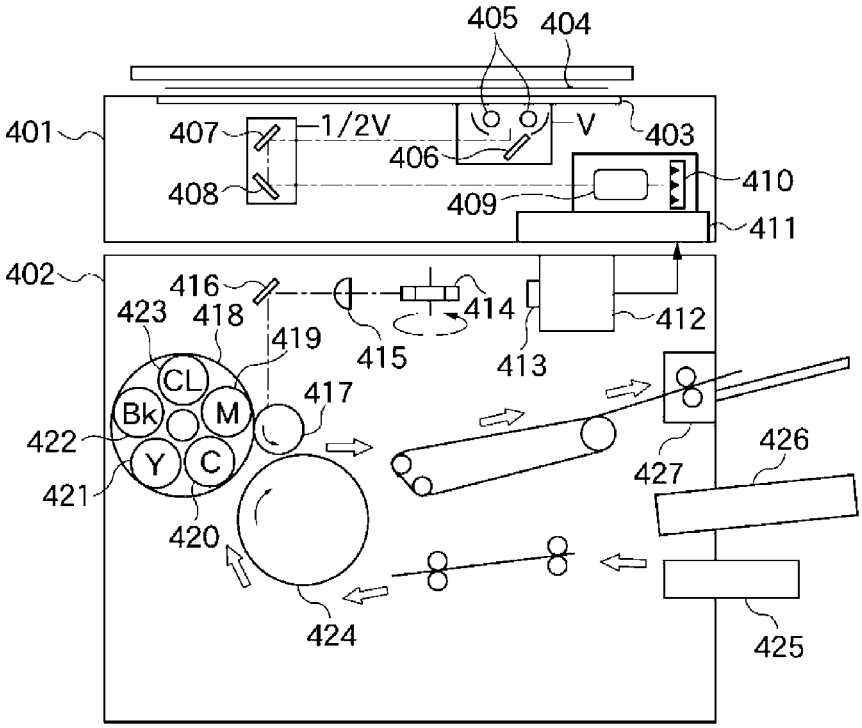
FIG. 4 is a schematic cross-sectional view showing the mechanical configuration of hardware of the MFP.

In FIG. 4, an image scanner section 401 (corresponding to the scanner section 304 in FIG. 3) scans an image from an original 404, and performs digital signal processing on the scanned image. A printer section 402 (corresponding to the printer section 305 in FIG. 3) prints out an image corresponding to the image scanned from the original 404 by the image scanner section 401, on a sheet in full color.

In the image scanner section 401, when light is irradiated from a lamp 405 onto the original 404 placed on an original platen glass 403, reflected light from the irradiated original is guided to mirrors 406, 407 and 408. The reflected light guided to the mirrors 406, 407 and 408 passes through a lens 409 to form an image on a 3-line image pickup element 410, and three signals, i.e. red (R), green (G), and blue (B) image signals as full-color information are sent from the image pickup element 410 to a signal processing section 411.

In the present embodiment, an image of the original 404 is read (i.e. scanned) e.g. at a resolution of 600 dpi in both the main scanning direction and the sub scanning direction, and read image signals are stored in a data storage unit of the signal processing section 411 on a page-by-page basis.

In the signal processing section 411, the image signals stored in the data storage unit are electrically processed on a pixel-by-pixel basis, thereby being separated into components of magenta (M), cyan (C), yellow (Y), and black (Bk), and then are sent to the printer section 402. Further, the signal processing section 411 has a clear pattern-generating section, not shown, provided therein for generating clear image data (CL) on a pixel-by-pixel basis, and transmitting the clear image data (CL) to the printer section 402. The clear image data is generated based on information (clear-toner image data) registered in advance in the MFP 102 or information received from an external apparatus.

The printer section 402 receives M, C, Y, Bk and CL image signals transmitted from the signal processing section 411, and transmits the received image signals to a laser driver 412. The laser driver 412 modulation-drives a semiconductor laser 413 according to the transmitted image signals. A laser beam emitted from the semiconductor laser 413 scans a photosensitive drum 417 via a polygon mirror 414, an f-θ lens 415, and a mirror 416.

A rotary developing device 418 comprises a magenta developing section 419, a cyan developing section 420, a yellow developing section 421, a black developing section 422, and a clear (transparent) developing section 423. The five developing sections 419 to 423 alternately come into contact with the photosensitive drum 417. Thus, the rotary developing device 408 develops an electrostatic latent image formed on the photosensitive drum 417, using the respective toners of the colors. A transfer drum 424 transfers the electrostatic latent image developed on the photosensitive drum 417 onto a sheet fed from a sheet cassette 425 or 426 and wound around the transfer drum 424.

Thus, the sheet having the five color toners i.e. the C, M, Y, Bk, and CL (transparent) toners sequentially transferred thereon passes through a fixing unit 427 to have the toners fixed thereon, followed by being discharged.

Next, an example of processing executed before image data generated by the PC 101 is printed by the MFP 102 will be described with reference to FIG. 5.

Figure 5:
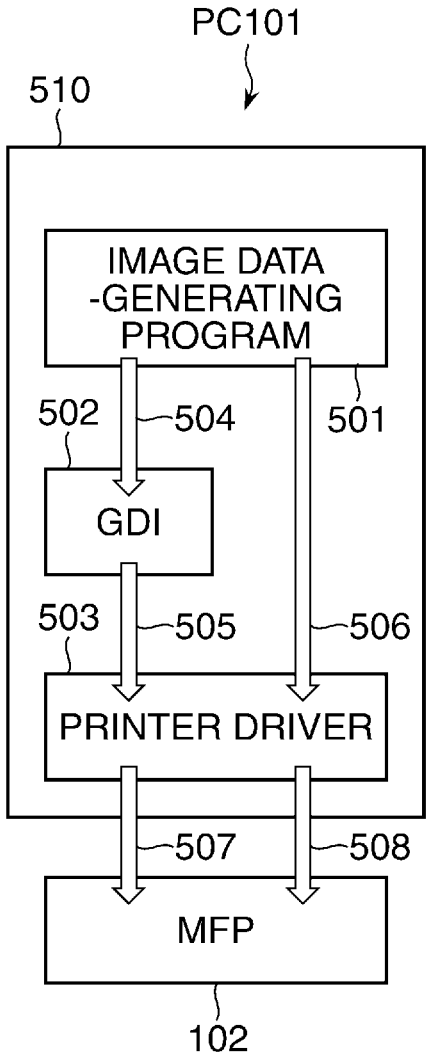
FIG. 5 is a diagram useful in explaining an example of processing executed before image data generated by the PC is printed by the MFP.

As shown in FIG. 5, the PC 101 includes an image data-generating program 501, a GDI (Graphic Device Interface) 502, and a printer driver 503, as software.

The image data-generating program 501 includes drawing and painting software, word processor software mainly for generating character data, form data generation software for generating business form data specified on a task basis, and so forth. The image data-generating program 501 transmits image data generated by the user and functions required for the GDI 502 to perform image processing on the image data, to the GDI 502 (504).

The GDI 502 is a drawing module of an OS (Operating System), and is one of programs for performing graphics processing. The GDI 502 accepts image data generated by the image data-generating program 501, converts the image data into data in a data format that can be processed by the printer driver 503, and transfers the converted data to the printer driver 503 (505).

The printer driver 503 converts the data transferred from the GDI 502 into PDL (Page Description Language) data, and sends the same to the MFP 102 (507).

Further, the image data-generating program 501 is capable of directly sending a request for execution of processing that cannot be executed by the GDI, e.g. a request for execution of image formation using the clear toner, to the printer driver 503 (506). In this case, the printer driver 503 sends an image to be printed with the clear toner to the MFP 102 (508).

The MFP 102 receives the PDL data and the image to be printed with the clear toner, analyzes the received PDL data, thereby performing printing using the C, M, Y, and Bk toners, and further prints the received image to be printed with the clear toner (CL), using the clear toner, followed by fixing the toners. This makes it possible to make a print product printed with the clear toner.

Figure 6:
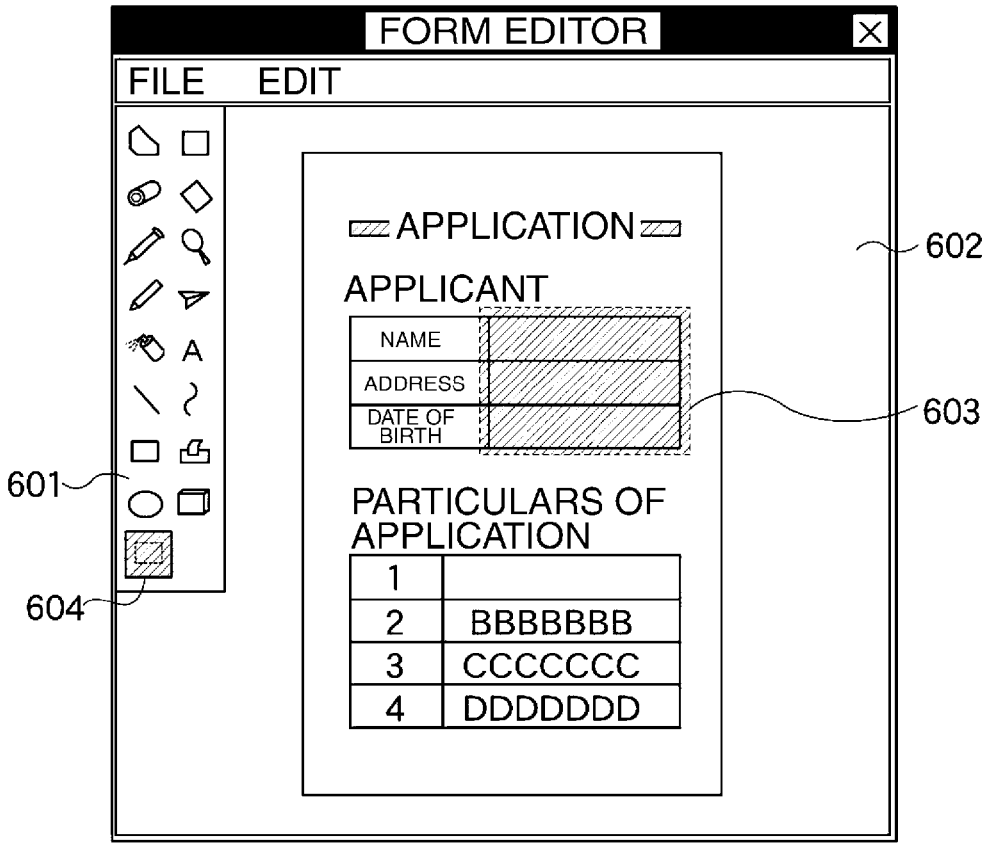
FIG. 6 is a diagram useful in explaining processing performed using form data generation software.

Next, processing carried out by the PC 101 using the form data generation software will be described with reference to FIG. 6. FIG. 6 is a diagram showing an example of an execution screen that is displayed on the display section 205 of the PC 101 when the form data generation software is run.

The form data generation software generates a business form document by acquiring data that varies from page to page via a file or a network and superimposing the data upon a business form template specified on a task basis. By using the form data generation software, similarly to the drawing and painting software, it is possible not only to edit frame lines and character strings of the business form template but also to draw a polygonal area to be printed with the clear toner.

A palette 601 is a collection of tools for drawing and painting. The user can designate a desired one of the tools of the palette 601 by operating the operation section 204 and use the designed tool for image drawing. In the palette 601, reference numeral 604 denotes a clear-toner area designation tool for designating an area on which the clear toner is to be placed (where a clear-tone image is to be printed). If the user drags the mouse of the operation section 204 in a state where the clear-toner area designation tool 604 is selected, it is possible to designate an area on which the clear toner is to be placed.

Reference numeral denotes a canvas 602 of editing software. The user can prepare a template diagram by operating drawing and painting tools selected on the canvas 602 using the mouse or the keyboard.

A clear-toner area 603 can be prepared by selecting the clear-toner area designation tool 604 and dragging and dropping the same with the mouse on the canvas 602. Although the clear-toner area 603 has a rectangular shape, it may have a round shape.

Figure 7:
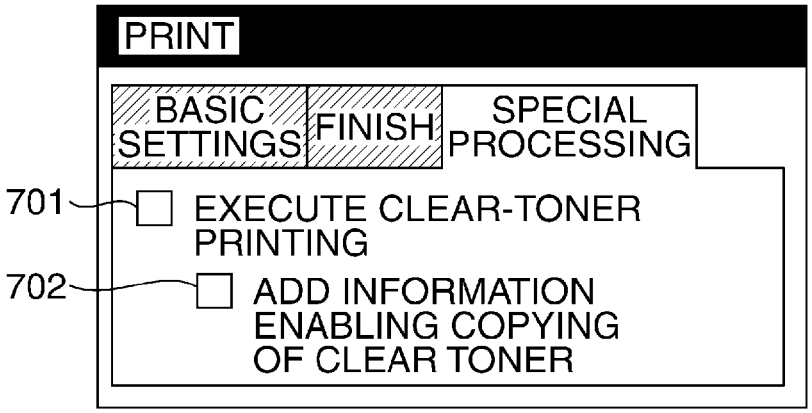
FIG. 7 is a view of a printer driver configuration screen.

Next, a configuration screen of the printer driver will be described with referenced to FIG. 7. FIG. 7 is a view showing an example of the configuration screen for configuring clear toner-related settings, which is one of printer driver configuration screens to be displayed on the display section 205 of the PC 101. In the present embodiment, a description will be given of a case where print data is transmitted from the PC 101 to the MFP 102, for printing.

In FIG. 7, a check box 701 is for the user to designate whether or not a clear-toner image generated by the image data-generating program 501 is to be printed. If an instruction for printing is given in a state where the check box 701 is checked, the PC 101 instructs the MFP 102, which is to execute the printing, to perform clear-toner printing using the clear toner as well.

On the other hand, if the instruction for printing is given in a state where the check box 701 is not checked, the PC 101 instructs the MFP 102, which is to execute the printing, to perform normal printing using only toners other than the clear toner.

When the MFP 102 cannot perform clear-toner printing e.g. due to shortage of the clear toner, it is only required to cause the MFP 102 to notify the PC 101 of the fact and cause the PC 101 to display the check box 701 in a grayed-out state to make it impossible to check the check box 701.

A check box 702 is for designating whether or not to add information for enabling the clear-toner image to be copied. If an instruction for printing is given in a state where the check box 702 is checked, the PC 101 instructs the MFP 102 to embed printing position information (image forming position information) on the clear-toner image, in a print product.

This enables the scanner section 304 of the MFP 102 to read the printing position information on the clear-toner image embedded in the print product, and copy the clear-toner image based on the printing position information. Further, even an MFP other than the MFP 102 can copy the clear-toner image based on the printing position information insofar as it has the same configuration as that of the MFP 102. When the check box 701 for clear-toner printing is off, i.e. not checked, the check box 702 is displayed in a grayed-out state, which makes it impossible to check the check box 702.

Although in the present embodiment, as an example of a method of embedding the printing position information on the clear toner, there is employed a method in which redundant information is added to digital information, and the resulting digital information is subjected to two-dimensional frequency decomposition so as to thinly and widely dispose dots all over the sheet, this is not limitative. For example, the printing position information on the clear toner may be a two-dimensional barcode or other suitable information.

Next, the structure of data sent from the printer driver 503 of the PC 101 to the MFP 102 will be described with reference to FIG. 8.

Figures 8, 9, 10:
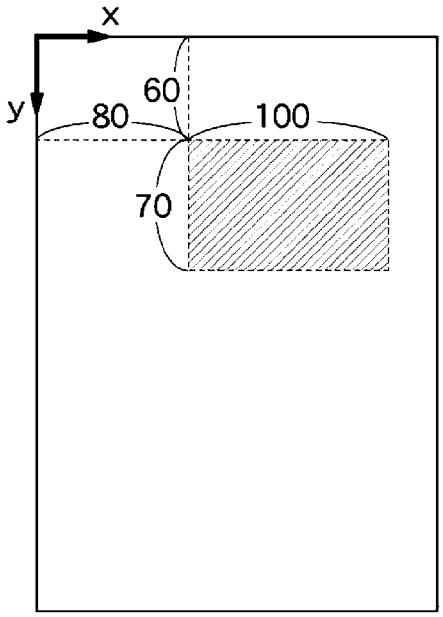
FIG. 8 is a diagram showing an example of a structure of data transmitted from the printer driver of the PC to the MFP.
FIG. 9 is a diagram showing an example of settings of a clear-toner area section concerning clear-toner printing, which is included in the data structure shown in FIG. 8.
FIG. 10 is a diagram of a clear-toner image-printing area designated based on information stored in the clear-toner area section shown in FIG. 9.

In FIG. 8, a header section 801 contains the size of the whole data, a creator of the data, information on sheets for printing the data thereon, security information, and so forth.

A graphic section 802 stores the kinds, positions, sizes, colors, and so forth of graphics created by the drawing tools, on a graphic-by-graphic basis.

A data correspondence definition section 803 stores information concerning which part of data is to be superimposed on which graphic of a template and how it is to be superimposed thereon. For example, information that a third column of data in a CSV (Comma Separated Values) format is to be superimposed within a rectangular graphic at an upper right portion of the page as a character string.

An object section 804 stores information on special parameter-requiring ones of the graphics. The object section 804 is broadly divided into an image section 805 and a clear-toner area section 806.

The image section 805 stores not only the positions and sizes of images but also paths of image files or image data per se.

The clear-toner area section 806 stores information on the clear-toner area. The stored information has four types of contents: the shape of the clear-toner area, the position of the same, the size of the same, and the inclination of the same.

Next, an example of processing executed before the clear-toner image is actually printed will be described with reference to FIGS. 9 and 10.

FIG. 9 is a diagram showing an example of settings of the clear-toner area section 806 concerning clear-toner printing, which is included in the data structure shown in FIG. 8. FIG. 10 is a diagram of a clear-toner area where a clear-toner image is to be printed, which is designated based on the information stored in the clear-toner area section 806 shown in FIG. 9.

As described above, the clear-toner area section 806 stores the four types of contents: the shape, the position, the size, and the inclination, of the clear-toner area.

As shown in FIG. 10, the data structure shown in FIG. 9 indicates that a clear-toner image is printed in an area defined by 100 (pixels) along the X axis and 70 (pixels) along the Y axis, which extends from a starting position at 80 (pixels) distant along the X axis and 60 (pixels) distant along the Y axis from a upper left corner of the image data. In this data structure, the origin of coordinates indicating positions is located at the upper left corner of the sheet surface, as viewed in FIG. 10. The length is measured in the number of pixels.

Figure 11:
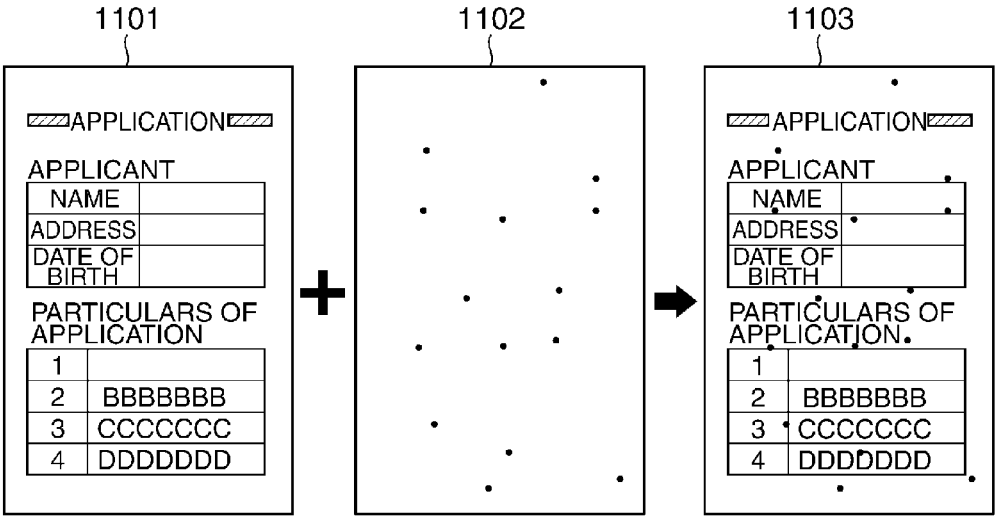
FIG. 11 is a diagram useful in explaining processing performed for encoding printing position information indicative of a position where a clear-toner image should be printed into a dot image, and synthesizing the dot image with image data.

FIG. 11 is a diagram useful in explaining processing performed for encoding printing position information indicative of a position where a clear-toner image should be printed into a dot image, and synthesizing the dot image with image data.

In FIG. 11, image data 1101 is generated by the image data-generating program 501. A dot image 1102 is generated by encoding the printing position information on the clear toner shown in FIG. 9. This dot image 1102 is generated by the CPU 201 of the PC 101 based on designation of the clear-toner printing, which is generated by the image data-generating program 501.

The printer driver 503 generates image data 1103 in which the image data 1101 and the dot image 1102 are superimposed one upon the other. The printer driver 503 transmits the image data 1103 to the MFP 102 as data to be printed with the C, M, Y, and Bk toners.

Figure 12:
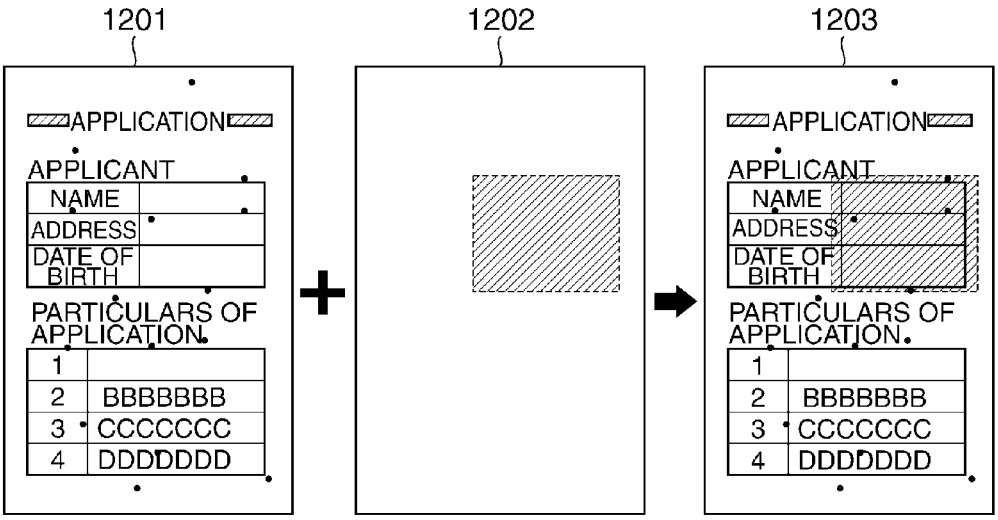
FIG. 12 is a diagram useful in explaining processing performed by the MFP for superimposing image data to be printed with C, M, Y, and Bk toners and image data to be printed with a clear toner, one upon the other.

FIG. 12 is a diagram useful in explaining processing performed by the MFP 102 for superimposing image data to be printed with the C, M, Y, and Bk toners, and image data to be printed with the clear toner, one upon the other.

In FIG. 12, reference numeral 1201 represents image data synthesized by the printer driver 503. Reference numeral 1202 represents image data for clear-toner printing set by the image data-generating program 501. Reference numeral 1203 denotes an image printed by the MFP 102, in which an image printed based on the image data 1201 and an image printed based on the image data 1202 are superimposed one upon the other.

First, the CPU 301 of the MFP 102 obtains the image data 1201 and the image data 1202 by rasterizing data received from the printer driver 503 of the PC 101. Subsequently, the MFP 102 prints the image data 1201 with the C, M, Y, and Bk toners, prints the image data 1202 with the clear toner such that the printed image is superimposed on the printed image of the image data 1201, and outputs the resulting printed image of the image data 1203. Now, it is advisable for the MFP 102 to perform the printing with the C, M, Y, and Bk toners and the clear toner (CL) by the following method: The C, M, Y, and Bk toners are printed on a sheet fed from the sheet cassette 425 or 426 based on the image data 1201, and are fixed by the fixing unit 427, and then the sheet printed with the C, M, Y, and Bk toners is discharged. Thereafter, when a start key, not shown, is pressed after the discharged sheet is set on the sheet cassette 425 or 426 again, the MFP 102 is controlled such that printing using the clear toner is performed based on the image data 1202.

Figure 13:
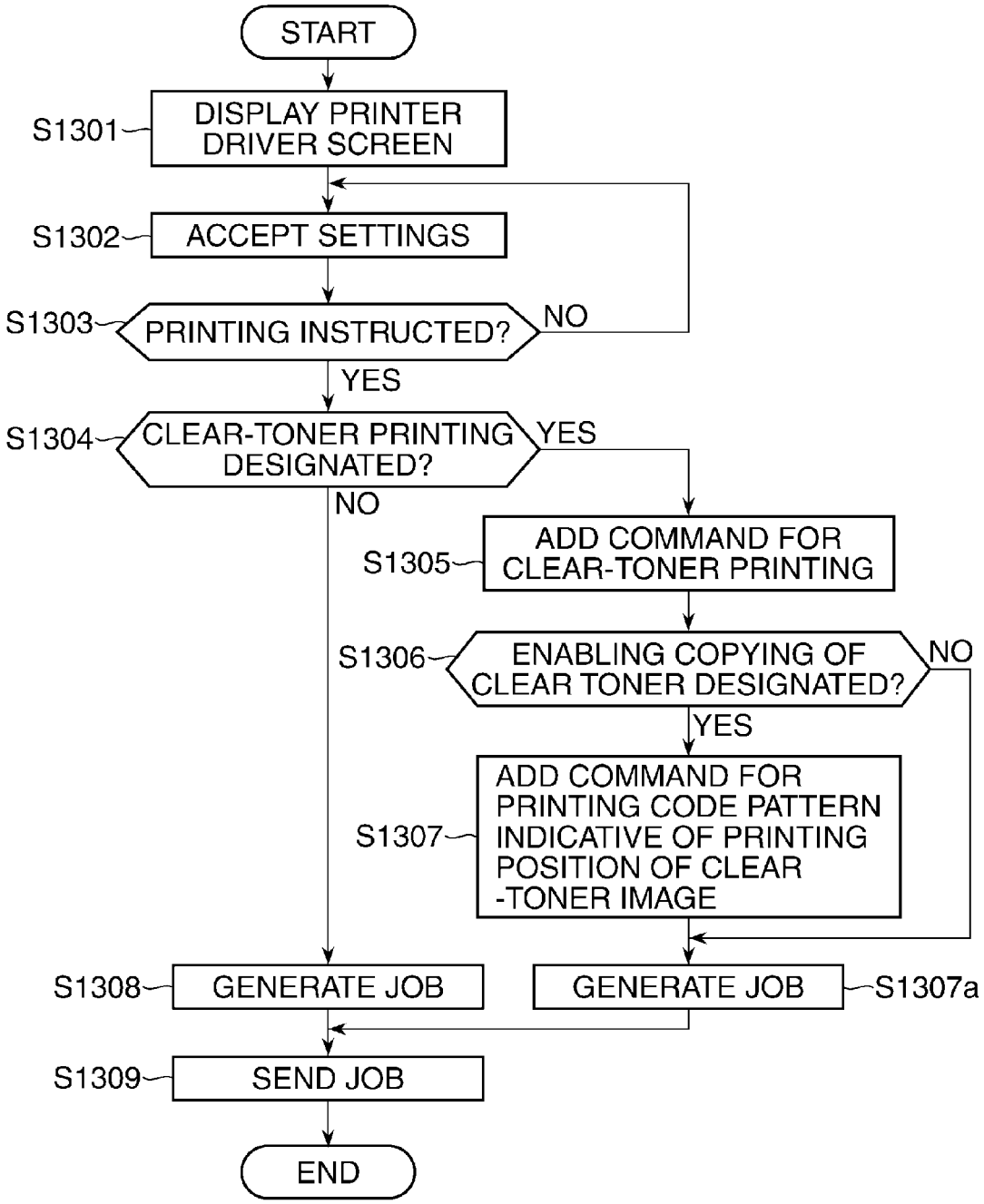
FIG. 13 is a flowchart of a print job generation and transmission process executed by the PC.

Next, a print job generation and transmission process executed by the PC 101 will be described with reference to FIG. 13. The steps in FIG. 13 are executed by the CPU 201 after loading an associated control program stored in the ROM 202, the HDD 206 or the like of the PC 101 into the RAM 203.

In a step S1301, the CPU 201 displays the configuration screen of the printer driver 503 in FIG. 7 on the display section 205, and then the process proceeds to a step S1302.

In the step S1302, the CPU 201 accepts printing-related settings from the user via the operation section 204, and then the process proceeds to a step S1303.

In the step S1303, the CPU 201 determines whether or not an instruction for executing printing has been given via the configuration screen of the printer driver 503. The CPU 201 repeatedly carries out the steps S1302 and S1303 until the instruction has been given. When the CPU 201 determines that the instruction has been given, the process proceeds to a step S1304.

In the step S1304, the CPU 201 checks the settings made on the printer driver configuration screen, and determines whether or not clear-toner printing is designated. If clear-toner printing is designated, the process proceeds to a step S1305, whereas if clear-toner printing is not designated, the process proceeds to a step S1308.

In the step S1305, the CPU 201 adds a command for clear-toner printing to settings of a print job, and the process proceeds to a step S1306.

In the step S1306, the CPU 201 determines whether or not it is designated to enable copying of a clear-toner image. If the CPU 201 determines that it is designated to enable copying of a clear-toner image, the process proceeds to a step S1307, whereas if not, the process proceeds to a step S1307*a*.

In the step S1307, the CPU 201 adds a command for printing a code pattern indicative of the printing position of the clear-toner image to the settings of the print job, and then the process proceeds to the step S1307*a*.

In the step S1307*a*, the CPU 201 generates the print job, and the process proceeds to a step S1309.

On the other hand, in the step S1308, the CPU 201 generates a print job that designates execution of normal printing using the toners of C, M, Y, and Bk, and then the process proceeds to the step S1309.

In the step S1309, the CPU 201 transmits the print job generated in the step S1308 or S1307*a* to the MFP 102, followed by terminating the present process.

Figure 14:
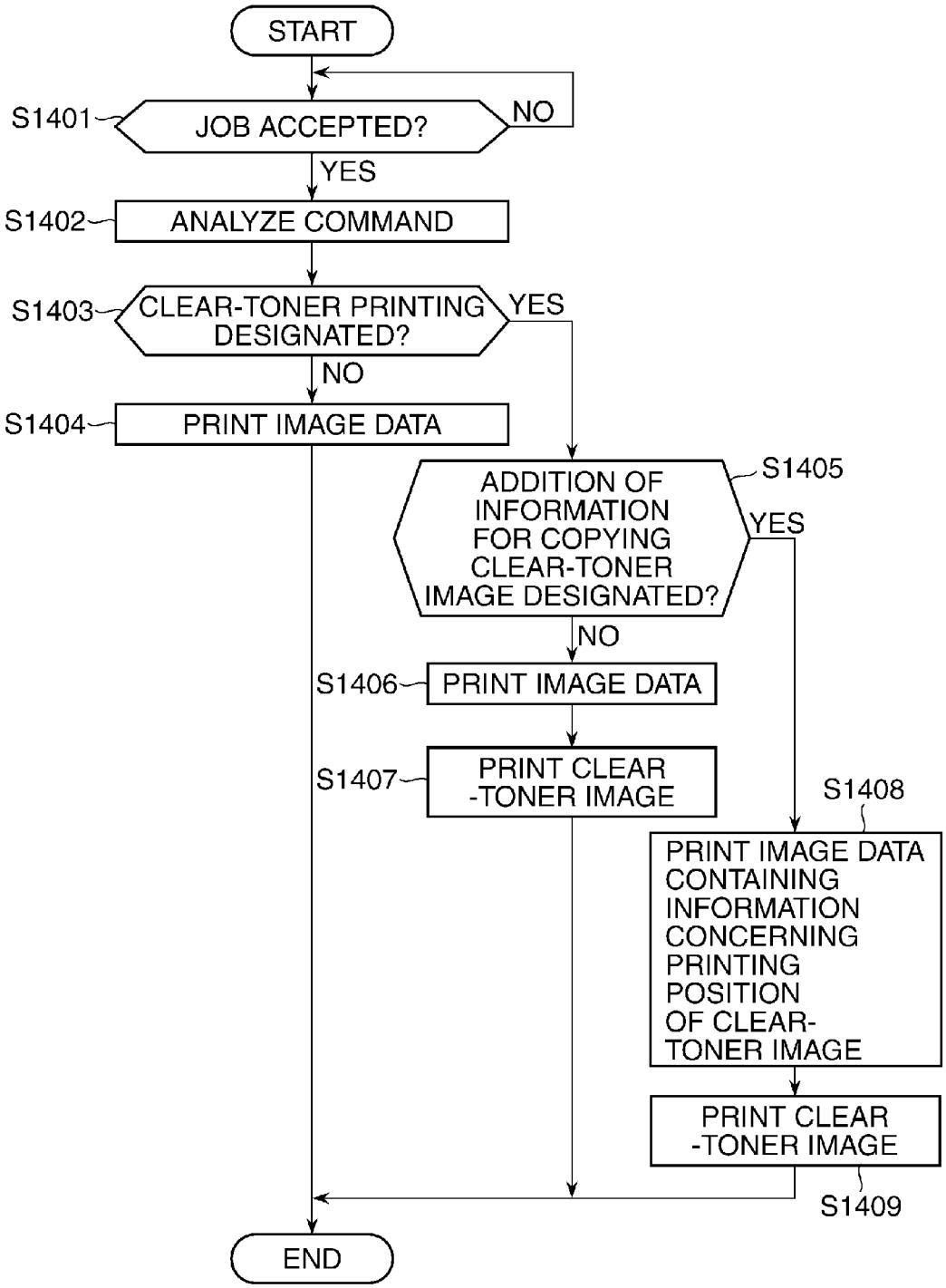
FIG. 14 is a flowchart of a printing process executed by the MFP, for performing printing based on data received from the PC.

Next, a printing process which is executed by the MFP 102, for performing printing based on data received from the PC 101 will be described with reference to FIG. 14. The steps in FIG. 14 are executed by the CPU 301 after loading an associated control program stored in the ROM 302, the HDD 308 or the like of the MFP 102 into the RAM 303.

In a step S1401, the CPU 301 determines whether or not the print job transmitted from the PC 101 has been received. If the print job has been received, the process proceeds to a step S1402.

In the step S1402, the CPU 301 stores the received print job in the HDD 308, and analyzes the stored print job, and then the process proceeds to a step S1403.

In the step S1403, the CPU 301 determines based on the result of the analysis of the print job in the step S1402 whether or not the execution of clear-toner printing is designated in the print job.

If the CPU 301 determines that the execution of clear-toner printing is not designated in the print job, the process proceeds to a step S1404, wherein the CPU 301 performs normal printing of the image data using the toners of C, M, Y, and Bk, followed by terminating the present process.

On the other hand, if the CPU 301 determines that the execution of clear-toner printing is designated in the print job, the process proceeds to a step S1405.

In the step S1405, the CPU 301 determines whether or not the addition of information for copying a clear-toner image is designated in the print job.

If it is determined by the CPU 301 that the addition of information for copying the clear-toner image is not designated in the print job, the process proceeds to a step S1406, whereas if it is determined that the addition of information for copying the clear-toner image is designated in the print job, the process proceeds to a step S1408.

In the step S1406, the CPU 301 prints the image data using the toners of C, M, Y, and Bk, and then the process proceeds to a step S1407.

In the step S1407, the CPU 301 prints the clear-toner image based on the instruction for the clear-toner printing, received from the PC 101, followed by terminating the present process.

On the other hand, in the step S1408, the CPU 301 superimposes the image data which represents the information indicative of the printing position of the clear-toner image as a dot image on the image data to be printed with the toners of C, M, Y, and Bk, and prints the resulting superimposed image data. Then, the process proceeds to a step S1409.

In the step S1409, the CPU 301 prints the clear-toner image based on the instruction for clear-toner printing, received from the PC 101, followed by terminating the present process.

Figure 15:
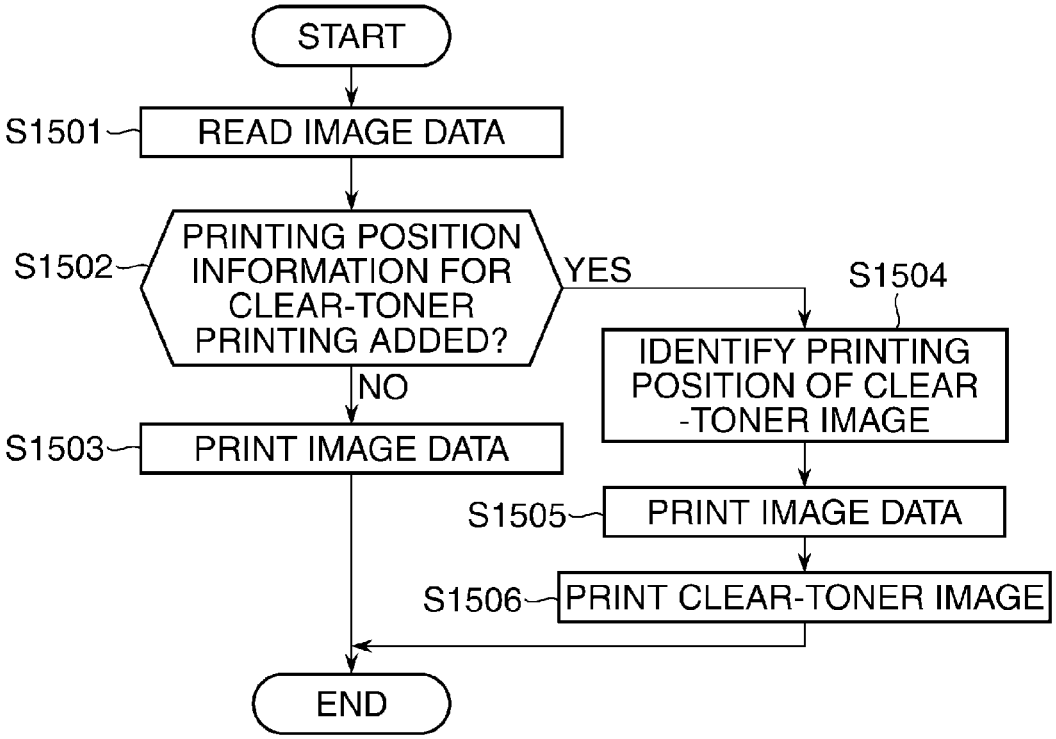
FIG. 15 is a flowchart of a copy process executed by the MFP, for copying an original.

Next, a copy process for copying an original, which is executed by the MFP 102, will be described with reference to FIG. 15. The steps in FIG. 15 are executed by the CPU 301 after loading an associated control program stored in the ROM 302, the HDD 308 or the like of the MFP 102 into the RAM 303.

In a step S1501, the CPU 301 reads an image of the original using the scanner section 304, and then the process proceeds a step S1502.

In the step S1502, the CPU 301 determines whether or not the image data read in the step S1501 contains printing position information added thereto for clear-toner printing.

If the CPU 301 determines that the image data contains no printing position information added thereto for clear-toner printing, the process proceeds to a step S1503, wherein the CPU 301 performs normal printing of the read image data with the toners of C, M, Y, and Bk, followed by terminating the present process.

On the other hand, if the CPU 301 determines that the image data contains the printing position information added thereto for clear-toner printing, the process proceeds to a step S1504.

In the step S1504, the CPU 301 identifies a position where the clear-toner image should be printed, based on the printing position information, and then the process proceeds to a step S1505.

In the step S1505, the CPU 301 prints the image data of the original read in the step S1501, and then the process proceeds to a step S1506.

In the step S1506, the CPU 301 prints the clear-toner image at the printing position identified in the step S1504, followed by terminating the present process.

As described above, according to the present embodiment, the printing position information on the clear-toner image is added to the image of the original, whereby it is possible to copy the clear-toner image which cannot be read by the scanner section.

Next, an image processing system according to a second embodiment of the present invention will be described with reference to FIGS. 16 to 23. Here, component elements identical to those of the above-described first embodiment are denoted by the same numerals, and description thereof is omitted.

In the above-described first embodiment, to copy an original, the CPU 301 of the MFP 102 reads an image of the original on the original platen glass 403, and determines the printing position of a clear-toner image by using the upper left corner of the read image data as the origin. As a result, unless the user sets the original properly in abutment with the upper left corner of the original platen glass 403, it is impossible to accurately print the clear toner on the read image data.

Figure 16:
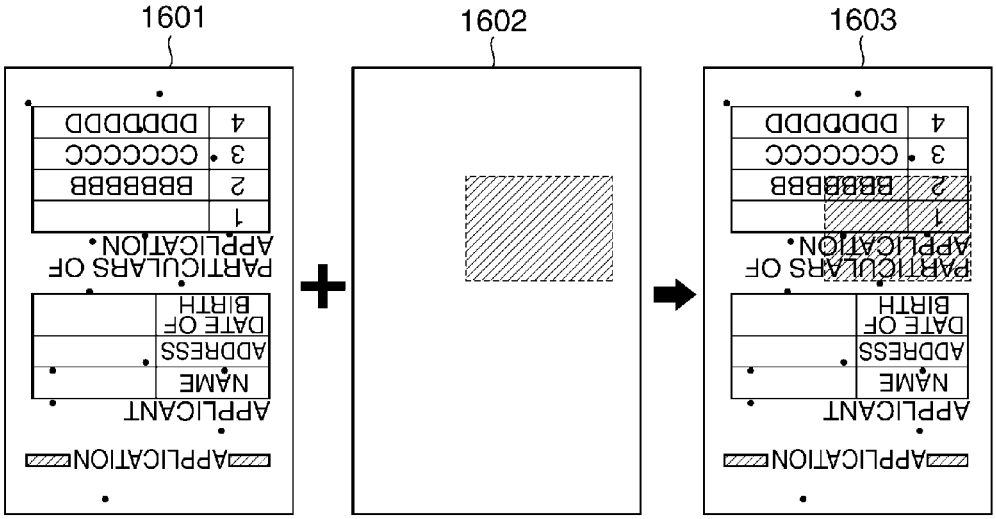
FIG. 16 is a view useful in explaining processing performed on image data of an original when the original is placed upside down on an original platen glass of an image forming apparatus (MFP) in an image processing system according to a second embodiment of the present invention.

Specifically, FIG. 16 is a view showing an original 1601 placed upside down on the original platen glass 403. When an image of the original 1601 is read in this state by the scanner section 304, image data of the original 1601 is also upside down.

In the above-described first embodiment in which the position and the orientation of image data of the original 1601 are not corrected with respect to extracted position information of the clear toner, the area (clear-toner area) of image data of the clear-toner image is calculated from a position determined with reference to the origin at the upper left corner of the original 1601. Therefore, image data printed using the clear toner is as denoted by a reference numeral 1602.

The MFP 102 superimposes the image data 1602 of the clear toner on the image data of the original 1601 printed with the normal toners of C, M, Y, and Bk, and prints the superimposed image data. This results in a printed image of image data 1603 different from an image of image data originally desired to be printed.

Figure 17:
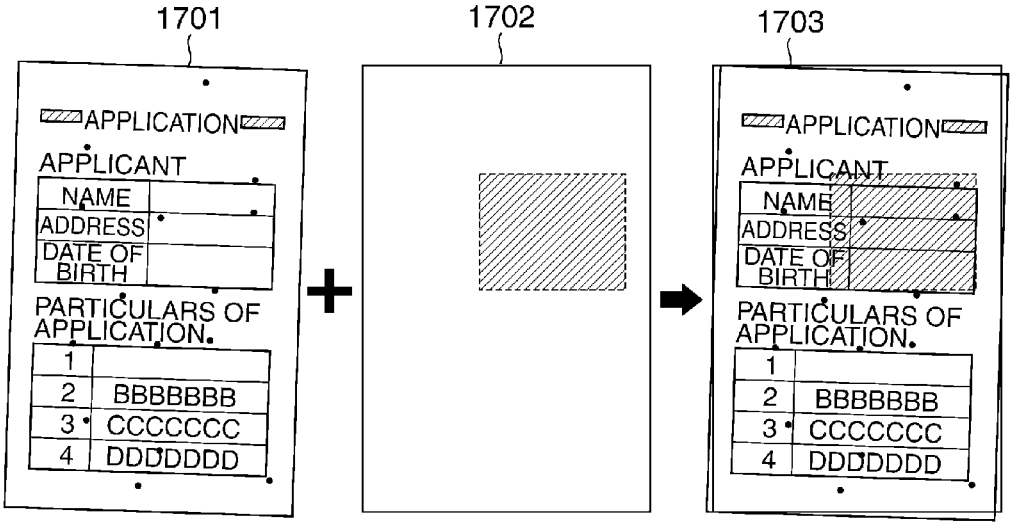
FIG. 17 is a view useful in explaining processing performed on image data of an original when the original is placed on the original platen glass in a displaced state.

FIG. 17 shows a case where an original 1701 placed on the original platen glass 403 in a displaced state is read by the scanner section 304 for copying.

When the original 1701 is placed on the original platen glass 403 in a displaced state, as described above, the position of image data of the original 1701 to be copied is displaced from the position of a clear-toner image 1702. Therefore, similarly to FIG. 16, this results in a printed image of image data 1703 different from one originally desired to be printed.

To cope with this inconvenience, in the present embodiment, one of graphics to be read from the original by the scanner section 304 is determined in advance as a reference graphic, and the positional relationship between the printing position of the reference graphic and that of the clear-toner image is recorded in the original as image definition information.

Then, in copying the original having the image definition information recorded therein, the image definition information recorded in the original is read by the scanner section 304, and the clear-toner image is printed based on the positional relationship between the printing position of the reference graphic and that of the clear-toner image.

This makes it possible to copy the clear-toner image at an accurate position even when the original is placed on the original platen glass 403 in a displaced state.

Next, a description will be given of details of control by the PC 101 and the MFP 102.

Figures 18, 19:
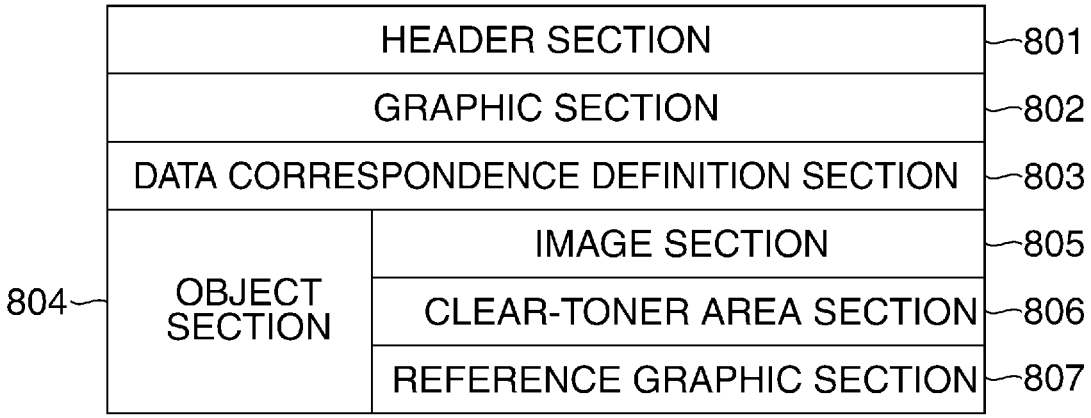
FIG. 18 is a diagram showing an example of a structure of data transmitted from a printer driver of an information processing apparatus (PC) to the image forming apparatus (MFP) in the image processing system according to the second embodiment.
FIG. 19 is a diagram showing an example of settings of a clear-toner area section and a reference graphic section concerning clear-toner printing, which is included in the data structure shown in FIG. 18.

FIG. 18 is a diagram showing an example of a structure of data transmitted from the printer driver 503 of the PC 101 to the MFP 102. As shown in FIG. 18, in the present embodiment, a reference graphic section 807 is added to the object section 804 of the data structure shown in FIG. 8.

As shown in FIG. 19, the reference graphic section 807 stores a graphic ID. The graphic ID stored in the reference graphic section 807 is information indicative of which of graphics in the image data is to be used as a reference graphic for identifying a reference position for use in copying the clear-toner area.

The CPU 201 of the PC 101 encodes information (shape, position, size, inclination, colors, etc.) of the reference graphic by the printer driver 503 to form an image definition image, and adds the image definition image to the image data. The printer driver 503 sends the image data having the image definition image added thereto and the clear-toner image data to the MFP 102. The MFP 102 performs printing according to the image data and the clear-toner image data received from the printer driver 503.

The reference graphic may be designated by the user or automatically determined by the CPU 201 of the PC 101.

Figure 20:
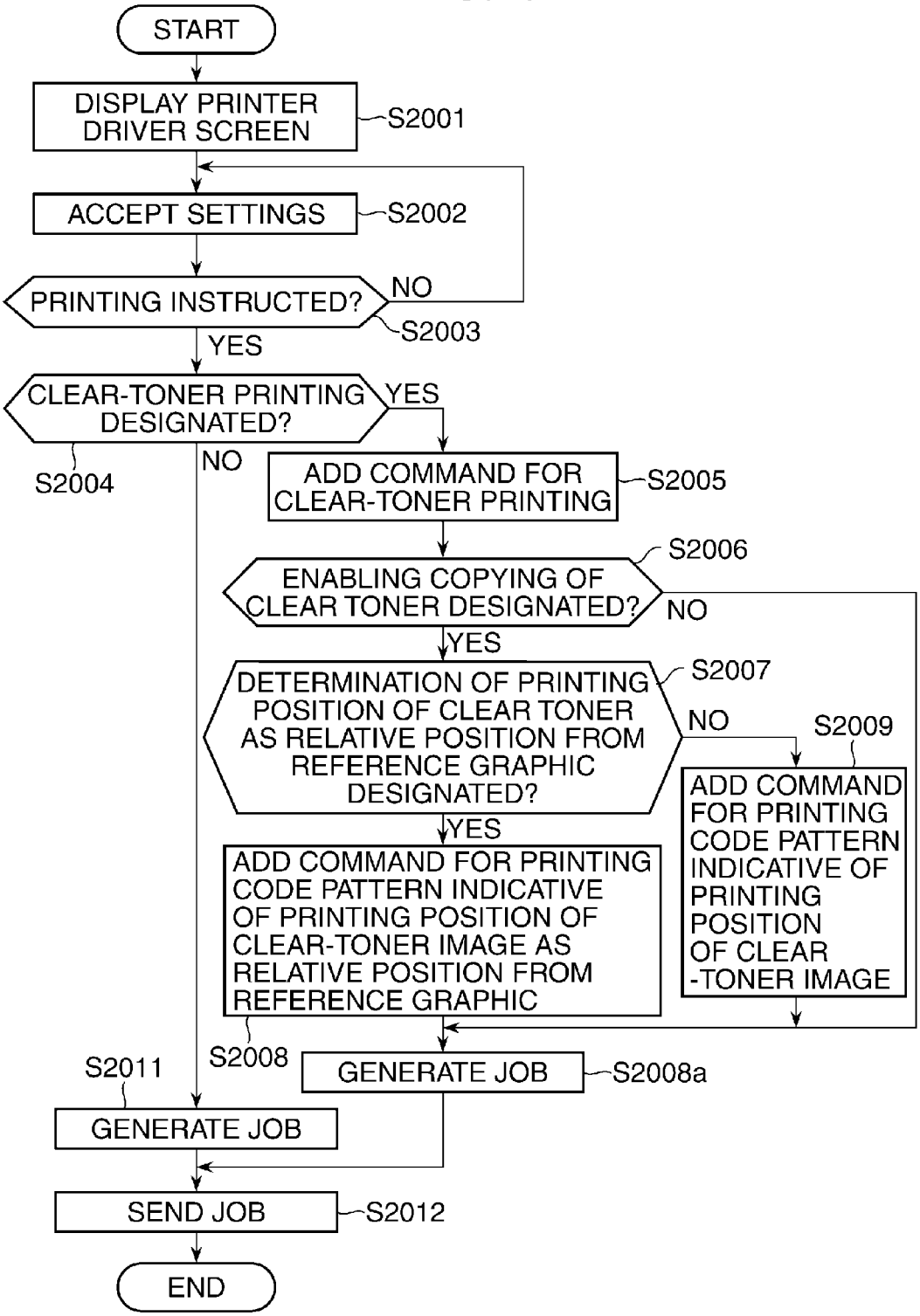
FIG. 20 is a flowchart of a print job generation and transmission process executed by the PC.

Next, a print job generation and transmission process executed by the PC 101 will be described with reference to FIG. 20. The steps in FIG. 20 are executed by the CPU 201 after loading an associated control program stored in the ROM 202, the HDD 206 or the like of the PC 101 into the RAM 203.

In a step S2001, the CPU 201 displays the configuration screen of the printer driver 503 in FIG. 7 on the display section 205, and then the process proceeds to a step S2002.

In the step S2002, the CPU 201 accepts printing-related settings from the user via the operation section 204, and then the process proceeds to a step S2003.

In the step S2003, the CPU 201 determines whether or not an instruction for executing printing has been given via the configuration screen of the printer driver 503. The CPU 201 repeatedly carries out the steps S2002 and S2003 until the instruction has been given. When the CPU 201 determines that the instruction has been given, the process proceeds to a step S2004.

In the step S2004, the CPU 201 determines whether or not the execution of clear-toner printing has been designated via the configuration screen of the printer driver 503.

If the execution of clear-toner printing has been designated, the process proceeds to a step S2005, whereas if the execution of clear-toner printing has not been designated, the process proceeds to a step S2011.

In the step S2005, the CPU 201 adds a command for clear-toner printing to settings of a print job, and then the process proceeds to a step S2006.

In the step S2006, the CPU 201 determines whether or not it is designated via the configuration screen of the printer driver 503 to enable copying of a clear-toner image.

If the CPU 201 determines that it is designated to enable copying of a clear-toner image, the process proceeds to a step S2007, whereas if not, the process proceeds to a step S2008*a*.

In the step S2007, the CPU 201 determines whether or not it is designated to determine the printing position of the clear-toner image using a relative position from the reference graphic.

If the CPU 201 determines that it is designated to determine the printing position of the clear-toner image using a relative position from the reference graphic, the process proceeds to a step S2008, whereas if not, the process proceeds to a step S2009.

In the step S2008, the CPU 201 adds a command (corresponding to the reference graphic section shown FIG. 18) for printing a code pattern representing the printing position of the clear-toner image as a relative position from the reference graphic, to the settings of the print job, and then the process proceeds to the step S2008*a*.

On the other hand in the step S2009, the CPU 201 adds a command for printing a code pattern indicative of the printing position of the clear-toner image, to the settings of the print job, and then the process proceeds to the step S2008*a*.

In the step S2008*a*, the CPU 201 generates the print job containing the added commands, and then the process proceeds to a step S2012.

On the other hand, in the step S2011, the CPU 201 generates a print job that designates normal printing with the toners of C, M, Y, and Bk, and then the process proceeds to the step S2012.

In the step S2012, the CPU 201 transmits the print job generated in the step S2008*a* or S2011 to the MFP 102, followed by terminating the present process.

Figure 21:
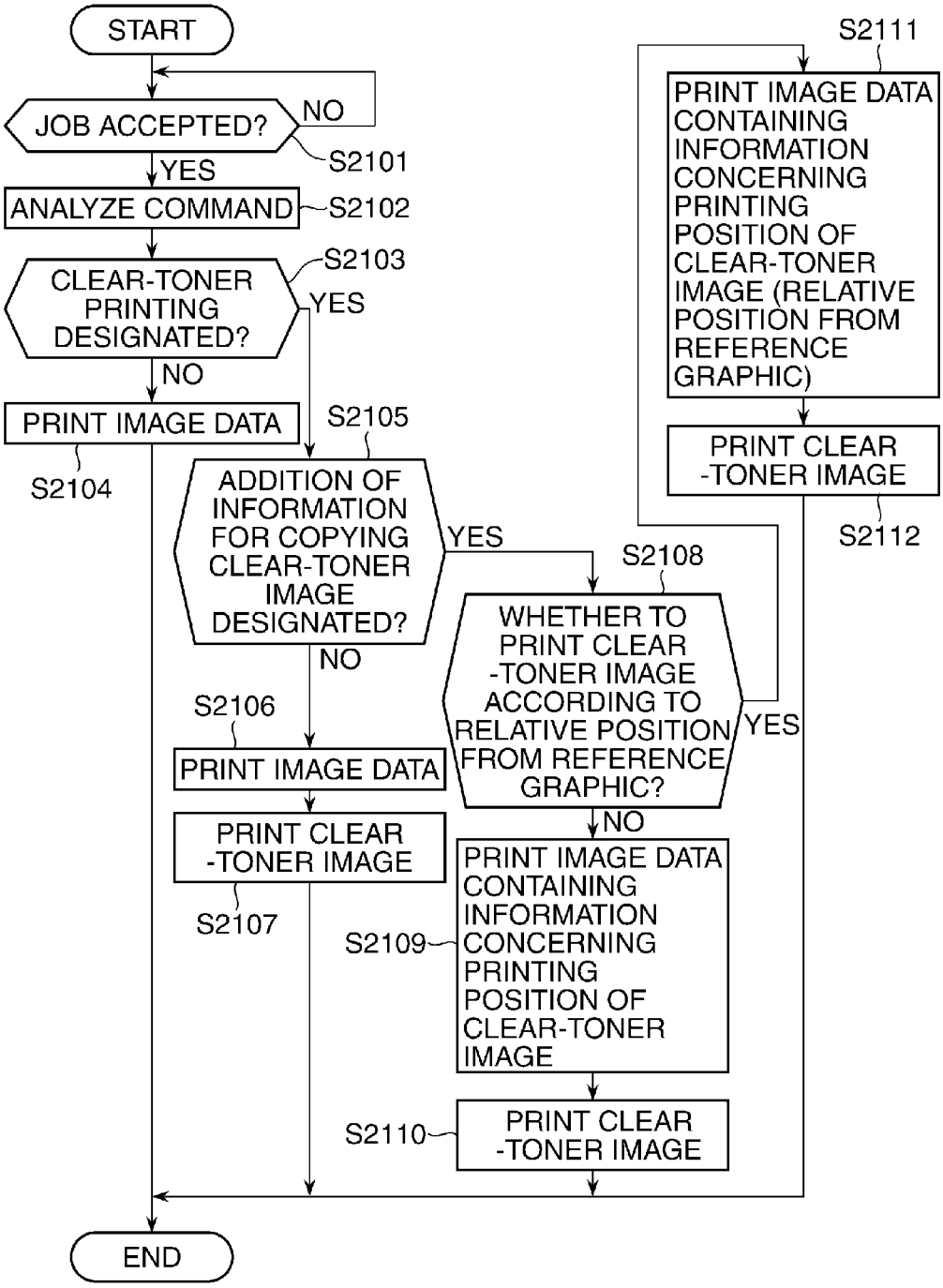
FIG. 21 is a flowchart of a printing process executed by the MFP, for performing printing based on data received from the PC.

Next, a printing process executed by the MFP 102, for performing printing based on data received from the PC 101 will be described with reference to FIG. 21. The steps in FIG. 21 are executed by the CPU 301 after loading an associated control program stored in the ROM 302, the HDD 308 or the like of the MFP 102 into the RAM 303.

In a step S2101, the CPU 301 determines whether or not the print job has been received from the PC 101. If the print job has been received, the process proceeds to a step S2102.

In the step S2102, the CPU 301 stores the print job received in the step S2101 in the HDD 308, and analyzes the stored print job, and then the process proceeds to a step S2103.

In the step S2103, the CPU 301 determines based on the result of the analysis of the print job in the step S2102 whether or not the execution of clear-toner printing is designated in the print job.

If the CPU 301 determines that the execution of clear-toner printing is not designated in the print job, the process proceeds to a step S2104, wherein the CPU 301 performs normal printing of the image data using the toners of C, M, Y, and Bk, followed by terminating the present process.

On the other hand, if the CPU 301 determines that the execution of clear-toner printing is not designated in the print job, the process proceeds to a step S2105.

In the step S2105, the CPU 301 determines whether or not the addition of information for copying the clear-toner image is designated in the print job.

If it is determined by the CPU 301 that the addition of information for copying the clear-toner image is not designated in the print job, the process proceeds to a step S2106, whereas if it is determined that the addition of information for copying the clear-toner image is designated in the print job, the process proceeds to a step S2108.

In the step S2106, the CPU 301 prints the image data using the toners of C, M, Y, and Bk, and then the process proceeds to a step S2107.

In the step S2107, the CPU 301 prints the clear toner based on the instruction for clear-toner printing, received from the PC 101, followed by terminating the present process.

In the step S2108, the CPU 301 determines whether or not it is designated to execute printing of the clear-toner image according to a relative position with respect to the reference graphic. If it is designated to execute printing of the clear-toner image according to the relative position with respect to the reference graphic, the process proceeds to a step S2111, whereas if not, the process proceeds to a step S2109.

In the step S2109, the CPU 301 adds information concerning the printing position of the clear-toner image to the image data to be printed with the toners of C, M, Y, and Bk, and performs printing based on the resulting image data, and then the process proceeds to a step S2110.

In the step S2110, the CPU 301 prints the clear toner based on the instruction for clear-toner printing, received from the PC 101, followed by terminating the present process.

On the other hand, in the step S2111, the CPU 301 adds information concerning the printing position of the clear-toner image (relative printing position from the reference graphic) to the image data to be printed with the toners of C, M, Y, and Bk, and performs printing based on the resulting image data, and then the process proceeds to a step S2112.

In the step S2112, the CPU 301 prints the clear-toner image based on the instruction for clear-toner printing, received from the PC 101, followed by terminating the present process.

Figure 22:
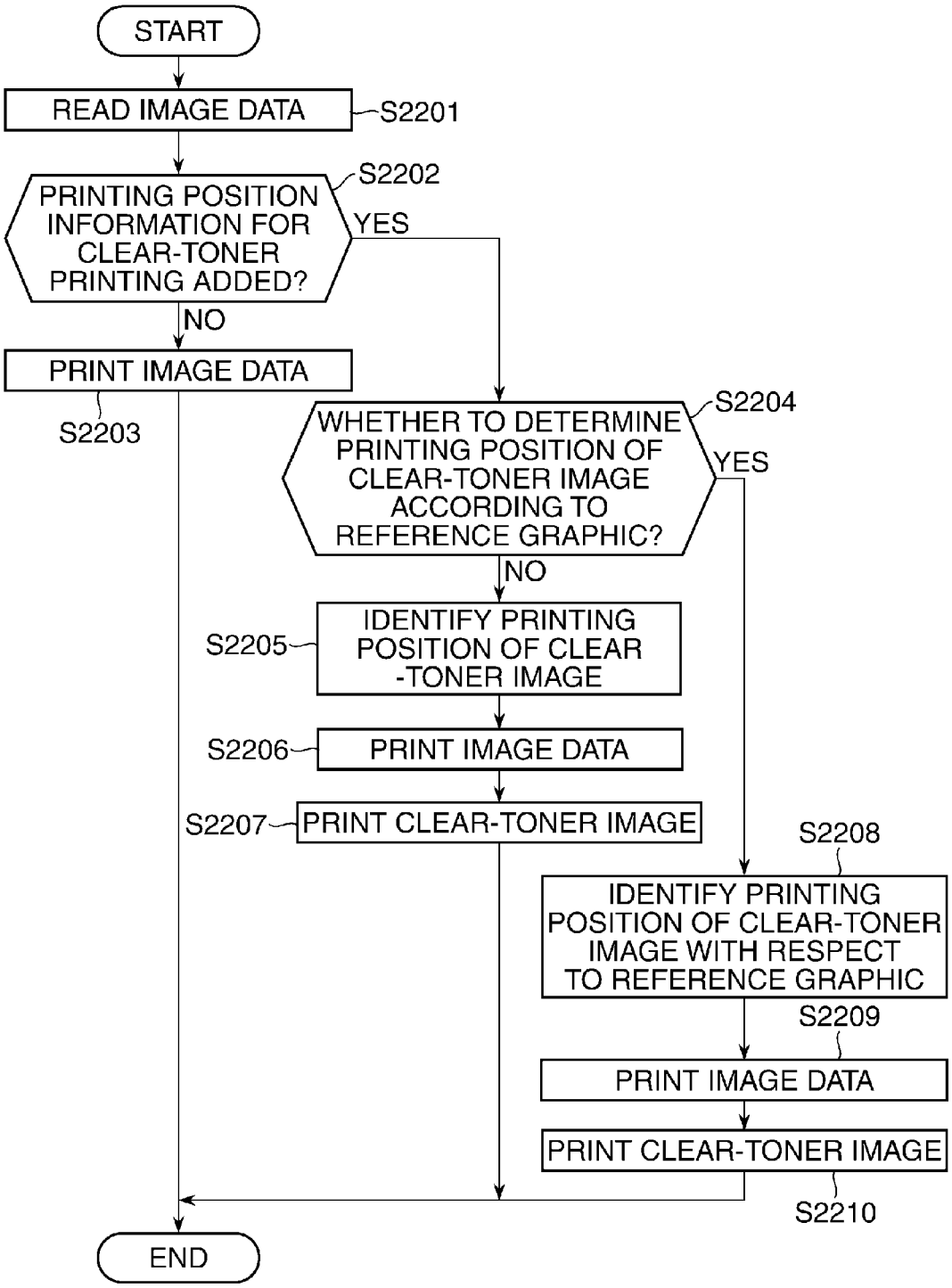
FIG. 22 is a flowchart of a copy process executed by the MFP, for copying an original.

Next, a copy process for copying an original, which is executed by the MFP 102, will be described with reference to FIG. 22. The steps in FIG. 22 are executed by the CPU 301 after loading an associated control program stored in the ROM 302, the HDD 308 or the like of the MFP 102 into the RAM 303.

In a step S2201, the CPU 301 reads an image of an original using the scanner section 304, and then the process proceeds to a step S2202.

In the step S2202, the CPU 301 determines whether or not the image data read in the step S2201 contains printing position information added thereto for clear-toner printing.

If the CPU 301 determines that the image data contains no printing position information added thereto, the process proceeds to a step S2203, whereas if the CPU 301 determines that the image data contains printing position information added thereto, the process proceeds to a step S2204.

In the step S2203, the CPU 301 performs normal printing of the read image data with the toners of C, M, Y, and Bk, followed by terminating the present process.

On the other hand, in the step S2204, the CPU 301 determines whether or not the printing position of the clear-toner image is to be determined according to the reference graphic.

If the CPU 301 determines that the printing position of the clear-toner image is to be determined according to the reference graphic, the process proceeds to a step S2208, whereas if the CPU 301 determines that the printing position of the clear-toner image is not to be determined according to the reference graphic, the process proceeds to a step S2205.

In the step S2205, the CPU 301 identifies a position distant from the upper left corner of the original by a distance indicated by coordinate information indicative of the printing position of the clear-toner image, as the printing position of the clear-toner image, and then the process proceeds to a step S2206.

In the step S2206, the CPU 301 prints the read image data of the original, using the toners of C, M, Y, and Bk, and then the process proceeds to a step S2207.

In the step S2207, the CPU 301 prints a clear-toner image at the printing position identified in the step S2205, followed by terminating the present process.

On the other hand, in the step S2208, the CPU 301 identifies a reference graphic identified based on a graphic ID included in the printing position information for clear-toner printing, from the image data read in the step S2201. Then, the CPU 301 identifies a position that is distant from the identified reference graphic by a distance indicated by coordinate information indicative of the printing position of the clear-toner image described in the clear-toner area section 806, as the printing position of the clear-toner image, and then the process proceeds to a step S2209.

In the step S2209, the CPU 301 prints the read image data of the original, using the toners of C, M, Y, and Bk, and then the process proceeds to a step S2210.

In the step S2210, the CPU 301 prints the clear-toner image at the printing position identified in the step S2208, followed by terminating the present process. Specifically, the CPU 301 prints the clear-toner image such that it extends from the printing position identified in the step S2208 over an area having a size defined in the clear-toner area section 806.

Figure 23:
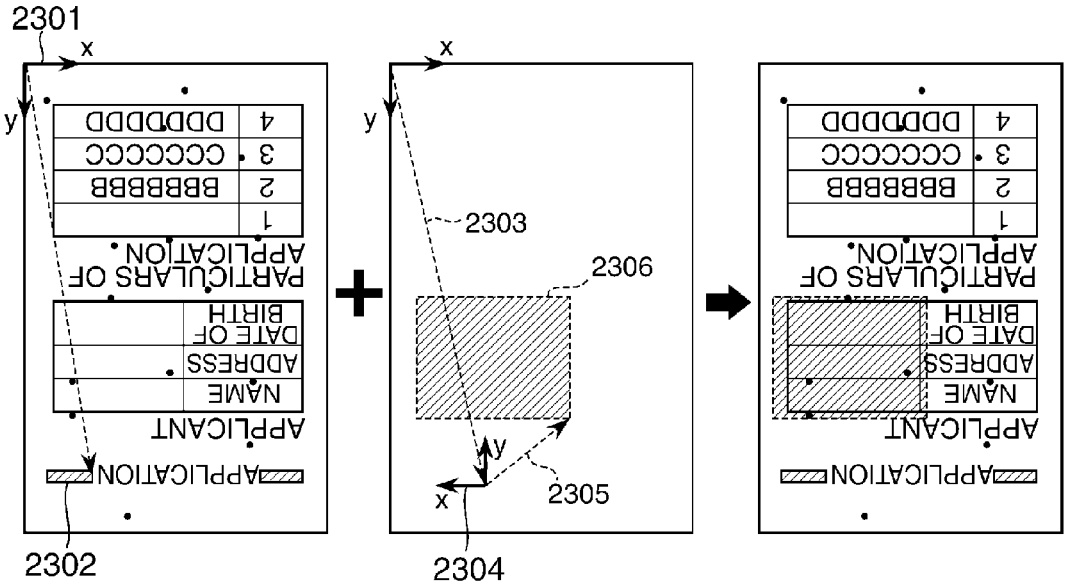
FIG. 23 is a view useful in explaining processing executed by a CPU of the MFP in steps S2208 to S2210 in FIG. 22.

FIG. 23 is a view useful in explaining processing executed by the CPU 301 of the MFP 102 in steps S2208 to S2210 in FIG. 22.

First, the CPU 301 extracts image definition information from the image data read by the scanner section 304 and takes out the information indicative of the printing position of the clear-toner image and information on a graphic ID from the extracted image definition information.

Then, the CPU 301 identifies a reference graphic based on the information on the graphic ID. In the example illustrated in FIG. 23, a rectangular graphic 2302 is registered in the HDD 308 as the reference graphic.

Next, the CPU 301 reads out the information indicative the printing position of the clear-toner image, from the image definition information. Then, with respect to a certain position of the reference graphic 2302, the CPU 301 identifies a position distant from the certain position by a distance of coordinates identified by the information indicative the printing position of the clear-toner image, as a starting point.

Then, the CPU 301 determines a printing area of the clear-toner image according to the size information and inclination information of the image definition information, corresponding to information included in the clear-toner area section 806, and prints the clear-toner image.

As described heretofore, according to the present embodiment, a reference graphic is determined in advance for use in determining a printing position of a clear-toner image based on information on a relative position from the reference graphic. This makes it possible to accurately superimpose and print the clear-toner image on an image of an original even when the original is placed on the original platen glass in a displaced state. The other configuration and the advantageous effects are the same as those of the above-described first embodiment.

A clear-toner image is effective not only in glossing and protecting the image of an original (original image) but also in making characters written thereon e.g. with a ballpoint pen difficult to blur. For example, as illustrated in FIG. 12, if the clear toner is added to entry boxes of a business form, there is an effect of suppressing blur of ink of a ballpoint pen when "name", "address" and "birth date" are entered using the ballpoint pen.

Such effects are not needed for characters already written in an application form. Therefore, in another embodiment, when copying an original (form), the CPU 301 of the MFP 102 identifies, based on printing position information added to the original, a position where a clear-toner image should be printed, and then determines whether or not there is any character written at the identified position. If the CPU 301 determines that there is no character written at the identified position, the CPU 301 executes clear-toner printing on the copy of the form. On the other hand, if the CPU 301 determines that there is any character written at the identified position, the CPU 301 does not execute clear-toner printing on the copy of the form.

Hereinafter, a description will be given of the process for executing such clear-toner printing. The arrangements of the PC 101, the MFP 102, and the MFP 103, and the arrangement of the image processing system are the same as those in the above-described embodiments, and hence detailed descriptions thereof are omitted.

The operation of the MFP 102 for copying an original having a clear toner added thereto is different from that in the above-described embodiment. Hereafter, a description will be given of the operation.

Referring to the flowchart shown in FIG. 15, the CPU 301 of the MFP 102 reads an image of the original using the scanner section 304 in the step S1501, and determines in the step S1502 whether or not the image data corresponding to the read image contains printing position information added thereto for clear-toner printing.

If the CPU 301 determines in the step S1503 that the image data corresponding to the read image contains printing position information added thereto for clear-toner printing, the process proceeds to the step S1504.

In the step S1504, the CPU 301 identifies a position where a clear-toner image should be printed, based on the printing position information.

In the present embodiment, in this step S1504, the CPU 301 performs character recognition for recognizing characters at the identified position (area) in the read image, and determines as the result of the character recognition whether or not there is any character written in the identified position (area).

If the CPU 301 determines that there is no character written in the identified position (area), the process proceeds to a step S1505, wherein the CPU 301 prints the image data of the original read in the step S1501, and then the process proceeds to a step S1506. In the step S1506, the CPU 301 prints the clear-toner image at the printing position identified in the step S1504, followed by terminating the present process.

On the other hand, if the CPU 301 determines that there is any character written at the identified position (area), the CPU 301 displays a screen for causing the user to select whether or not to print the clear-toner image at the identified printing position, on the display section 205. Then, the CPU 301 accepts the selection whether or not to print the clear-toner image at the identified printing position, from the user via the operation section 204.

If the CPU 301 is instructed by the user not to print the clear-toner image at the identified printing position, the CPU 301 prints the image data of the original read in the step S1501, and terminates the process without executing the clear-toner printing at the identified printing position.

On the other hand, if the CPU 301 is instructed by the user to print the clear-toner image at the identified printing position, the CPU 301 prints the image data of the original read in the step S1501, and executes the clear-toner printing at the identified printing position, followed by terminating the present process.

As described above, it is determined whether or not the clear toner is to be placed at the position identified by the printing position information, depending on whether or not there is any character at the identified position, whereby it is possible to prevent clear-toner printing from being executed even when the user does not desire the addition of the clear toner.

The above description has been given of an example in which when the CPU 301 determines that there is any character written at the position identified by the printing position information, the user can select whether or not to execute the clear-toner printing at the identified position. However, the MFP 102 (image forming apparatus) may be configured in advance as to whether or not the CPU 301 performs clear-toner printing at the identified position when it determines that there is any character written at the position identified by the printing position information. Further, the MFP 102 (image forming apparatus) may be configured such that instead of accepting the above-described selection from the user, the CPU 301 is unexceptionally inhibited from performing clear-toner printing at the identified position when it determines that there is any character written at the position identified by the printing position information.

It is to be understood that the functions indicated by the flowcharts in the above-described embodiments can also be realized by executing software (a program(s)) acquired via a network or recording media using a processing apparatus, such as a CPU.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-131932, filed Jun. 1, 2009, which is hereby incorporated by reference herein in its entirety.

What is claimed is:

1. An image forming apparatus comprising:

a reading unit configured to read a first image formed with a color toner other than a clear toner from document sheet;

an obtaining unit configured to obtain, from the first image, position information indicating a position of a second image, which is formed with a clear toner on the document sheet; and an image forming unit configured to form the first image with the color toner, and to form the second image with the clear toner based on the position indicated by the position information.

2. The image forming apparatus according to claim 1, further comprising:

a reception unit configured to receive a print job from an external apparatus, wherein said image forming unit is configured to form the second image with the clear toner when a print instruction for the second image is included in the print job received by said reception unit and form an image including the position information with the color toner when a print instruction for the image is included in the print job.

3. The image forming apparatus according to claim 1, further comprising:

a printing unit, wherein said printing unit is configured to print, on a sheet, the first image formed by said image forming unit with the color toner and the second image formed by said image forming unit with the clear-toner.

4. The image forming apparatus according to claim 3, wherein the first image contains size information indicating a size of the second image and said printing unit is configured to print the second image on the sheet so that the second image extends from the position indicated by the position information over an area having the size indicated by the size information.

5. The image forming apparatus according to claim 4, wherein the first image further contains inclination information indicating an inclination of the second image and said printing unit is configured to print the second image at the area on the sheet with the inclination indicated by the inclination information.

6. The image forming apparatus according to claim 1, wherein the position information is barcode information.

7. An information processing apparatus that transmits image data to an image forming apparatus, the information processing apparatus comprising:

a generation unit configured to generate position information indicating a position of an image to be formed with a clear toner; and a transmission unit configured to transmit the generated position information to the image forming apparatus to enable the image forming apparatus to print on a sheet, with a color toner, a predetermined image indicating the position of the image based on the position information generated by said generation unit, enabling the image forming apparatus to read the predetermined image from the sheet after printing and copy the image with the clear toner to another sheet based on the formed predetermined image.

8. The information processing apparatus according to claim 7, wherein the position information is barcode information.

9. A method of controlling an image forming apparatus, the method comprising the steps of:

reading a first image formed with a color toner other than a clear toner from a document sheet;

obtaining from the first image position information indicating a position of a second image, which is formed with a clear toner on the document sheet; and forming the first image with the color toner and forming the second image with the clear toner based on the position indicated by the position information.

10. A method of controlling an information processing apparatus that transmits image data to an image forming apparatus, the method comprising the steps of:

generating position information, indicating a position of an image formed with a clear toner; and transmitting the generated position information to the image forming apparatus to enable the image forming apparatus to print on a sheet, with a color toner, a predetermined image indicating the position of the image based on the generated position information, enabling the image forming apparatus to read the predetermined image from the sheet after printing and copy the image with the clear toner to another sheet based on the formed predetermined image.

11. A non-transitory computer-readable storage medium storing a computer program executable by a computer to execute a method of controlling an image forming apparatus, the method comprising the steps of:

reading a first image formed with a color toner other than a clear toner from a document sheet;

obtaining from the first image position information indicating a position of a second image formed with a clear toner on the document sheet; and forming the first image with the color toner and forming the image with the clear toner based on the position indicated by the position information.

12. A non-transitory computer-readable storage medium storing a computer program executable by a computer to execute a method of controlling an information processing apparatus, the method comprising the steps of:

generating position information, indicating a position of an image to be formed with a clear toner; and transmitting the generated position information to the image forming apparatus to enable the image forming apparatus to print on a sheet, with a color toner, a predetermined image indicating the position of the image based on the generated position information, enabling the image forming apparatus to read the predetermined image from the sheet after printing and copy the image with the clear toner to another sheet based on the formed predetermined image.

13. An information processing system comprising:

an image forming apparatus; and an information processing apparatus that transmits image data to the image forming apparatus, wherein the information processing apparatus comprises:

a generation unit configured to generate position information indicating a position of an image to be formed with a clear toner; and a transmission unit configured to transmit a print job to the image forming apparatus, wherein the image forming apparatus comprises:

a reception unit configured to receive the print job from the information processing apparatus; and an image forming unit configured to form the second image with the clear toner when a print instruction for the second image is included in the print job received by said reception unit and form an image including the position information with the color toner when a print instruction for the image is included in the print job.

* * * * *